US007591250B2

(12) United States Patent
Milton

(10) Patent No.: US 7,591,250 B2
(45) Date of Patent: Sep. 22, 2009

(54) PUMP RETAINING STRUCTURE FOR FUEL PUMP MODULE

(75) Inventor: Jeffery J. Milton, Lake Orion, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 565 days.

(21) Appl. No.: 11/472,286

(22) Filed: Jun. 22, 2006

(65) Prior Publication Data

US 2006/0289671 A1 Dec. 28, 2006

Related U.S. Application Data

(60) Provisional application No. 60/692,956, filed on Jun. 22, 2005.

(51) Int. Cl.
*F02M 37/22* (2006.01)

(52) U.S. Cl. ..... 123/509

(58) Field of Classification Search ..... 123/509, 123/598 C, 195 A, 198 C
See application file for complete search history.

(56) References Cited

U.S. PATENT DOCUMENTS

| | | | | |
|---|---|---|---|---|
| 3,659,965 | A | 5/1972 | Ebert et al. | |
| 4,716,931 | A | 1/1988 | Shibamoto | |
| 4,776,315 | A | 10/1988 | Greiner | |
| 4,961,693 | A | 10/1990 | Hoover et al. | |
| 5,046,471 | A | 9/1991 | Schmid | |
| 5,363,827 | A * | 11/1994 | Siekmann | 123/509 |
| 5,758,627 | A * | 6/1998 | Minagawa et al. | 123/509 |
| 5,769,061 | A * | 6/1998 | Nagata et al. | 123/509 |
| 5,782,223 | A * | 7/1998 | Yamashita et al. | 123/510 |
| 5,908,020 | A * | 6/1999 | Boutwell et al. | 123/541 |
| 5,960,775 | A * | 10/1999 | Tuckey | 123/509 |
| 6,158,975 | A * | 12/2000 | Dill et al. | 417/307 |
| 6,308,733 | B2 | 10/2001 | Murakoshi et al. | |
| 6,520,163 | B2 | 2/2003 | Yoshioka et al. | |
| 6,848,430 | B2 | 2/2005 | Bampfer | |
| 6,923,164 | B1 * | 8/2005 | Mitsudou et al. | 123/509 |
| 7,263,980 | B2 * | 9/2007 | Milton | 123/509 |
| 7,418,950 | B2 * | 9/2008 | Teets et al. | 123/509 |
| 2004/0037713 | A1 | 2/2004 | Schelhas et al. | |
| 2007/0107700 | A1 * | 5/2007 | Milton et al. | 123/509 |

FOREIGN PATENT DOCUMENTS

| | | | |
|---|---|---|---|
| DE | 3927218 | A1 | 2/1991 |
| EP | 203244 | A1 | 12/1986 |
| JP | 02245466 | A | 10/1990 |

* cited by examiner

*Primary Examiner*—Hai H Huynh

(57) ABSTRACT

A fuel pump module is provided for delivering fuel to an engine. The module includes a fuel pump 16 for pumping fuel to the engine. A filter 12 filters fuel prior to being pumped to the engine. A pump retaining structure 10 is coupled to the filter 12. The pump retaining structure 20 includes spring structure 22 constructed and arranged to resiliently support the fuel pump in a suspended manner with respect to the filter.

18 Claims, 3 Drawing Sheets

PUMP RETAINING STRUCTURE FOR FUEL PUMP MODULE

This application is based on U.S. Provisional Application No. 60/692,956, filed on Jun. 22, 2005 and claims the benefit of thereof for priority purposes.

FIELD OF THE INVENTION

This invention relates to fuel pump modules for automotive applications and, more particularly, to a pump retaining structure for resiliently retaining a fuel pump with respect to a filter of a fuel pump module.

BACKGROUND OF THE INVENTION

Conventional fuel pumps of fuel pump modules for vehicle applications are mounted generally between a fuel filter for filtering fuel prior to being delivered to an engine, and a bottom of a fuel tank. Due to conventional fuel pump mounting, pump noise and vibration can occur. In addition, it is difficult to account for pump assembly tolerances in assembling the pump module.

Thus, there is a need to provide a pump retaining structure to suspend the pump so as to account for pump assembly tolerances and to reduce pump noise and vibration.

SUMMARY OF THE INVENTION

An object of the invention is to fulfill the need referred to above. In accordance with the principles of the present invention, this objective is achieved by providing a fuel pump module for delivering fuel to an engine. The module includes a fuel pump for pumping fuel to the engine. A filter filters fuel prior to being pumped to the engine. A pump retaining structure is coupled to the filter. The pump retaining structure includes spring structure constructed and arranged to resiliently support the fuel pump in a suspended manner with respect to the filter.

In accordance with another aspect of the invention, a fuel pump module for delivering fuel to an engine. The module includes a fuel pump for pumping fuel to the engine. A filter filters fuel prior to being pumped to the engine. Means are coupled to the filter for resiliently supporting the fuel pump in a suspended manner with respect to the filter.

In accordance with yet another aspect of the invention, a pump retaining structure is provided for supporting a fuel pump with respect to a fuel filter. The pump retaining structure includes a base member constructed and arranged to be coupled to the filter, spring structure coupled to the base member at one end thereof, and a pump retaining member coupled to another end of the spring structure. The pump retaining member is in spaced relation with respect to the base member and is constructed and arranged to retain and support the pump in a suspended manner with respect to the filter.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawing, wherein like reference numerals refer to like parts, in which.

DETAILED DESCRIPTION OF THE EXEMPLARY EMBODIMENTS

Figure 1:
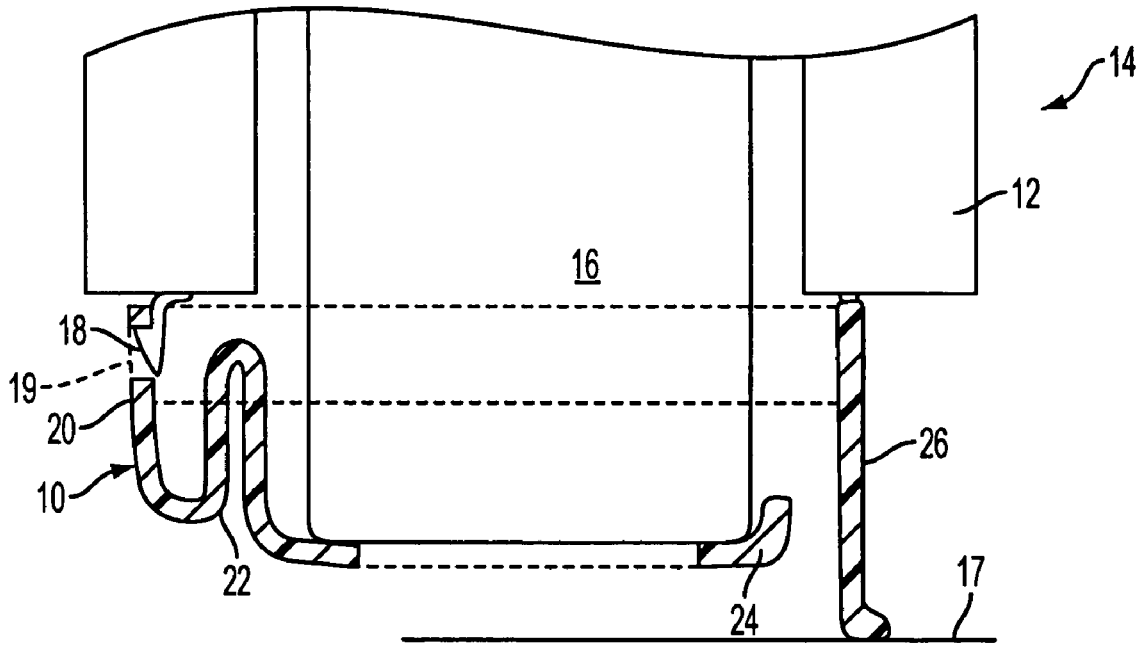
FIG. 1 is a schematic view of a pump retaining structure shown retaining a fuel pump with respect to a filter in accordance with the principles of the invention.
Figure 2A:
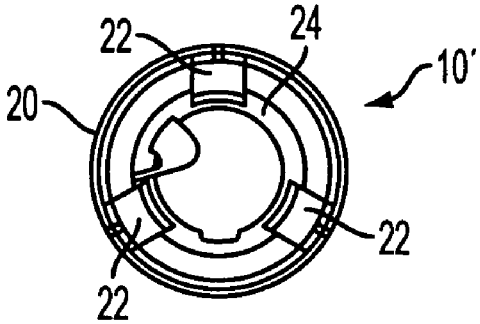
FIG. 2*a* is a plan view of a pump retaining structure of another embodiment of the invention.
Figure 2C:
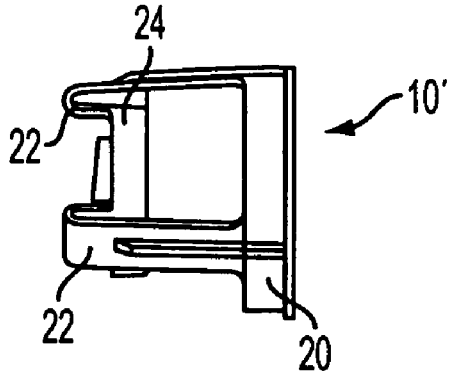
FIG. 2*c* is a side view of the pump retaining structure of FIG. 2*a*.
Figure 2B:
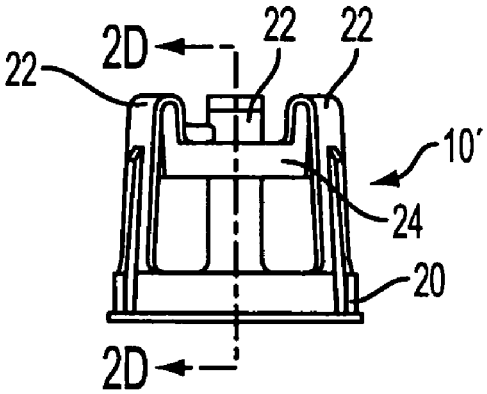
FIG. 2*b* is a front view of the pump retaining structure of FIG. 2*a*.
Figure 2D:
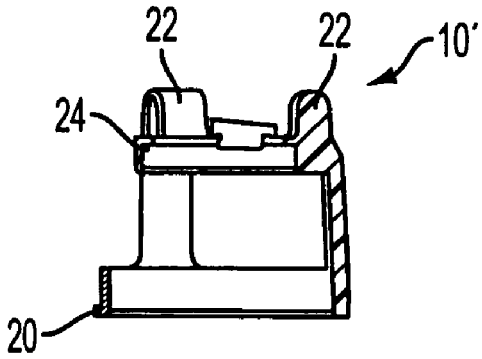
FIG. 2*d* is a sectional view of the pump retaining structure taken along the line 2*d*-2*d* of FIG. 2*b*.

With reference to FIG. 1, a pump retaining structure is shown, generally indicated at 10, in accordance with the principles of the invention. The pump retaining structure 10 is coupled to a filter 12 of a fuel pump module 14 so as to suspend a fuel pump 16 above a bottom 17 of a vehicle fuel tank. In the embodiment of FIG. 1, the filter 12 includes mounting structure preferably in the form of tabs 18 extending there-from. Each tab 18 is received by a mounting structure, preferably in the form of a recess 19, in a base member 20 of the pump retaining structure 10 in a clipping manner to secure the pump retaining structure 10 to the filter 12. It can be appreciated that the recesses can be provided in the filter 12 with the tabs being provided in the pump retaining structure 10. The pump retaining structure 10 is preferably made of resilient plastic that is suitable to be exposed to fuel.

In the embodiment of FIGS. 2*a*-2*d*, the pump retaining structure 10' has a base member 20 of generally cylindrical configuration. Spring structure 22 is coupled to the base member 20 at one end thereof with other end of the spring structure 22 being connected to a generally annular pump retaining member 24 that is in spaced relation with respect to the base member 20. In the embodiment, three spring structures 22 are provided. The spring structures 22 are generally U-shaped.

Figure 3:
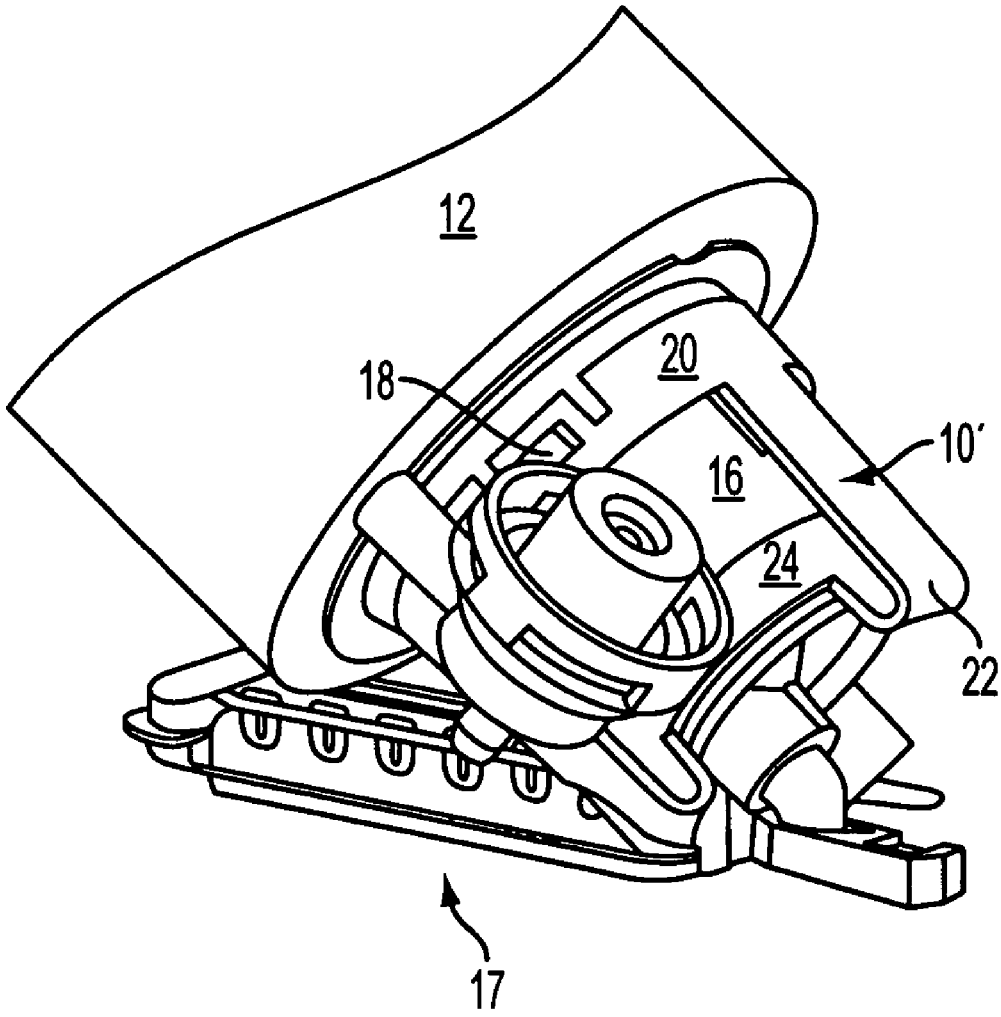
FIG. 3 is a perspective view of the pump retaining structure of FIG. 2*b* shown retaining a fuel pump in accordance with the invention.

The pump 16 can simply rest on the pump retaining member 24 (FIG. 1) or, as shown in FIG. 3, the pump retaining member 24 can engage an outer surface of the pump 16 so as so retain and support the pump 16.

With reference to FIG. 1, the pump retaining structure 10 can also include a bracket 26 that is constructed and arranged to support other components (e.g., regulator) when coupled thereto.

Thus, the pump retaining structure 10 with the spring structure 22 resiliently retains the pump 16 in a suspended manner with respect to the filter 12 and thus accounts for pump assembly tolerances and reduces pump noise and vibration.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel pump module for delivering fuel to an engine, the module comprising:

a fuel pump for pumping fuel to the engine, a filter for filtering fuel prior to being pumped to the engine, and a pump retaining structure coupled to the filter, the pump retaining structure including spring structure constructed and arranged to resiliently support the fuel pump in a suspended manner with respect to the filter, wherein the pump retaining structure includes a base member with the spring structure coupled to the base member at one end thereof with another end of the spring structure being connected to a pump retaining member that is in spaced relation with respect to the base member.

2. The module of claim 1, wherein the filter includes mounting structure and the pump retaining structure includes mounting structure associated with the mounting structure of the filter to couple the pump retaining structure to the filter.

3. The module of claim 2, wherein the mounting structure of the filter includes tabs extending from a surface of the filter and the mounting structure of the pump retaining structure includes a recess receiving an associated tab.

4. The module of claim 1, wherein the pump retaining structure is composed of resilient plastic material.

5. The module of claim 1, wherein the filter includes tabs extending from a surface thereof and the base member includes a recess receiving an associated tab to couple the pump retaining structure to the filter.

6. The module of claim 1, wherein the base member is coupled to the filter and the pump retaining member retains and supports the pump.

7. The module of claim 6, wherein the pump retaining member is constructed and arranged such that the pump rests on a surface of the pump retaining member.

8. The module of claim 6, wherein the pump retaining member is constructed and arranged so as to engage an outer surface of the pump.

9. The module of claim 1, wherein the spring structure includes a plurality of springs each of generally U-shape.

10. A fuel pump module for delivering fuel to an engine, the module comprising:

a fuel pump for pumping fuel to the engine, a filter for filtering fuel prior to being pumped to the engine, and means, coupled to the filter, for resiliently supporting the fuel pump in a suspended manner with respect to the filter, wherein the means for resiliently supporting includes a base member with spring structure coupled to the base member at one end thereof with another end of the spring structure being connected to a pump retaining member that is in spaced relation with respect to the to the base member.

11. The module of claim 10, wherein the filter includes mounting structure and the pump retaining structure includes mounting structure associated with the mounting structure of the filter to couple the pump retaining structure to the filter.

12. The module of claim 11, wherein the mounting structure of the filter includes tabs extending from a surface of the filter and the mounting structure of the pump retaining structure includes a recess receiving an associated tab.

13. The module of claim 10, wherein the means for resiliently supporting is composed of resilient plastic material.

14. The module of claim 10, wherein the base member is coupled to the filter and the pump retaining member retains and supports the pump.

15. The module of claim 14, wherein the pump retaining member is constructed and arranged such that the pump rests on a surface of the pump retaining member.

16. The module of claim 15, wherein the pump retaining member is constructed and arranged so as to engage an outer surface of the pump.

17. The module of claim 10, wherein the spring structure includes a plurality of springs each of generally U-shape.

18. A pump retaining structure for supporting a fuel pump with respect to a fuel filter, the pump retaining structure comprising:

a base member constructed and arranged to be coupled to the filter, generally U-shaped spring structure coupled to the base member at one end thereof, and a pump retaining member coupled to another end of the spring structure, the pump retaining member being in spaced relation with respect to the base member and being constructed and arranged to retain and support the pump in a suspended manner with respect to the filter.

* * * * *